US005801346A

United States Patent [19]

Taniuchi

[11] Patent Number: 5,801,346

[45] Date of Patent: Sep. 1, 1998

[54] ROTARY SWITCH

[75] Inventor: Ryoichi Taniuchi, Fukui-ken, Japan

[73] Assignee: Matsushita Electric Industrial Co., Ltd., Japan

[21] Appl. No.: 654,219

[22] Filed: May 28, 1996

[30] Foreign Application Priority Data

May 30, 1995 [JP] Japan ..... 7-131353

[51] Int. Cl.[6] ..... H01H 19/58

[52] U.S. Cl. ..... 200/11 K; 200/11 J; 200/564

[58] Field of Search ..... 200/11 R, 11 TW, 200/290, 291, 303, 564–572, 11 G, 11 J, 11 K; 74/527–542

[56] References Cited

U.S. PATENT DOCUMENTS

| | | | |
|---|---|---|---|
| 3,596,013 | 7/1971 | Pihl | 200/11 EA |
| 4,034,178 | 7/1977 | Koppenheffer et al. | 200/11 TW X |
| 4,267,412 | 5/1981 | Janssen et al. | 200/6 B |
| 4,490,588 | 12/1984 | Guenther et al. | 200/11 R |
| 4,551,587 | 11/1985 | Rose | 200/11 R |
| 4,679,588 | 7/1987 | Raab et al. | 200/16 C X |
| 5,001,316 | 3/1991 | Salaman | 200/303 X |
| 5,010,214 | 4/1991 | Yamazaki | 200/6 B |
| 5,589,671 | 12/1996 | Hackbarth et al. | 200/6 R |
| 5,594,220 | 1/1997 | Hackbarth et al. | 200/6 B |

*Primary Examiner*—J. R. Scott
*Attorney, Agent, or Firm*—Rossi & Associates

[57] ABSTRACT

A terminal plate 6 is formed into a circular cup shape having a bottom **6*b* and a cylindrical wall 6*a*. A plurality of terminals 14 are provided on bottom 6*b* of terminal plate 6. A rotor 1 is rotatably supported on terminal plate 6. A contact piece 5, resiliently engaged with rotor 1, is selectively brought into contact with terminals 14 to close a circuit. An undulated portion 10 is provided along the lower end cylindrical wall 1*b* of rotor 1. A ball 8, a spring 9 and undulated portion 10 cooperatively constitute an intermittent movement mechanism disposed between rotor 1 and terminal plate 6. Contact piece 5 intermittently rotates against a resilient force of spring 9 to change its rotational angle in accordance with a rotation of rotor 1. An elastically deformable portion 13 is formed on cylindrical wall 1*b* of rotor 1 while a rigid claw 12 is formed on the upper edge of cylindrical wall 6*a* of terminal plate 6, cooperatively constituting a snap-in mechanism. A guide shaft 7, extending upward from the center of terminal plate 6, is inserted into a bore 3 on the lower surface of rotor 1, so that rotor 1 is rotatably supported on terminal plate 6**.

9 Claims, 11 Drawing Sheets

ROTARY SWITCH

BACKGROUND OF THE INVENTION

1. Field of the Invention:

This invention generally relates to a rotary switch installable, for example, on an instrument panel board or an a steering wheel in a passenger compartment of an automotive vehicle, for operating various equipments installed on the vehicle, such as headlights, turn indicator lights, wiper blades, an air-conditioning system, an automatic cruising control system, etc.

2. Prior Art:

FIGS. 12 and 13 show an example of a conventional rotary switch. In the drawings, a shaft 51 is rotatably supported at the center of a casing 52. Assembled with this shaft 51 is a rotor 55 which holds a contact piece 54. A compression spring 53 resiliently urges the contact piece 54.

A pin 56, applied a resilient force by a compression spring 57, is brought into contact with an undulated portion 58 formed on an upper surface of rotor 55. Pin 56 is supported in a guide hole 59 formed in the casing 52. Pin 56, compression spring 57 and undulated portion 58 cooperatively constitute a means for causing an intermittent movement.

A screwed portion 60 is integrally formed on the top boss of casing 52. In assembling the rotary switch with an opponent part (not shown), this screwed portion 60 is inserted into the opponent part and securely fastened by a nut (not shown).

A terminal plate 61 holds terminals 62 thereon. Terminals 62 are engaged with terminal plate 61 by insert molding or insert caulking so as to form a circuit. Terminal plate 61 is supported by a snap fitting 63 formed on the side wall of casing 52. This terminal plate 61 and the contact piece 54 resiliently urged by compression spring 53 cooperatively constitute a means for opening or closing the circuit.

A connector 64, provided under the terminal plate 61, is a unit for sending out a signal of the control circuit to an external device (not shown).

An operation of the above-described conventional rotary switch will be explained. In its home position, pin 56 urged by compression spring 57 is engaged with a recess formed by two slant surfaces 58*a* and 58*b* of undulated portion 58 as shown in FIG. 13, being held in a mechanically or dynamically balanced condition. Rotor 55, together with undulated portion 58, is rotatable in synchronism with a rotation of shaft 51. As pin 56 is urged by compression spring 57, a significant torque is required when pin 56 slides on the waves of undulated portion 58 against the reaction force of compression spring 57. This torque is an operational torque.

When pin 56 is engaged with the recess of undulated portion 58, contact piece 54 is brought into contact with any one of terminals 62 to close the control circuit, agreeing with each operation position of the switch. Pin 56, compression spring 57 and undulated portion 58 cooperatively constitute a contact means for closing the control circuit.

However, according to the construction of the above-described conventional rotary switch, its size is fairly large due to the presence of casing 52 which is a necessary component for providing or assuring support to shaft 51, pin 56 and compression spring 57 as well as acting as a cover enclosing them. Provision of casing 52 is disadvantageous not only in the terms of size but also in terms of cost.

More specifically, the configuration of casing 52 requires a formation of the male screw portion at its top boss for engagement with the opponent part and also requires a formation of the snap-in mechanism for engagement with terminal plate 61. Such a complicated configuration will lead to difficulty in manufacturing the dies.

SUMMARY OF THE INVENTION

Accordingly, in view of above-described problems encountered in the prior art, a principal object of the present invention is to provide a rotary switch which is simple in configuration and inexpensive.

In order to accomplish this and other related objects, the present invention provides a novel and excellent rotary switch comprising a terminal plate formed into a circular cup shape having a bottom and a cylindrical wall, terminals provided on the bottom of the terminal plate, a rotor rotatably supported on the terminal plate, a contact piece resiliently engaged with the rotor so that the contact piece is selectively brought into contact with the terminals on the bottom of the terminal plate to close a circuit, and an intermittent movement mechanism disposed between the rotor and the terminal plate so as to allow the contact piece to intermittently rotate against a resilient force to change its rotational angle in accordance with a rotation of the rotor.

According to features of the preferred embodiments, an engaging claw is provided on a top of the cylindrical wall of the terminal plate, and the engaging claw is locked with an outer periphery of the rotor. A guide shaft is provided on a center of the bottom of the terminal plate so as to extend in an axial direction of the rotor, a stopper flange is provided on a top of the guide shaft, and a guide hole is formed on a center of the rotor so that the rotor is locked with the terminal plate by inserting the guide shaft into the guide hole.

Furthermore, according to the features of the preferred embodiments of the present invention, a plurality of slits extending in radial directions are provided around the guide hole. Or, an elastically deformable ring is formed around the guide hole.

Moreover, according to the features of the preferred embodiments of the present invention, a guide shaft is provided on a center of the bottom of the terminal plate so as to extend in an axial direction of the rotor, and the guide shaft is inserted into a bore formed on the rotor.

Alternatively, the guide shaft is provided at a center of the rotor so as to extend downward in an axial direction of the rotor, and the guide shaft is inserted into a bore formed on the bottom of the terminal plate.

Still further, according to the features of the preferred embodiments of the present invention, an undulated portion is continuously formed along a lower edge of a cylindrical wall of the rotor, while a ball urged by a spring is provided on the terminal plate, thereby bringing the ball into contact with the undulated portion under a resilient force of the spring so as to constitute the intermittent movement mechanism.

Alternatively, an undulated portion is continuously formed along an inside surface of the cylindrical wall of the terminal plate, while a ball urged by a spring is lodged in a bore formed on a side surface of the rotor, thereby bringing the ball into contact with the undulated portion under a resilient force of the spring so as to constitute the intermittent movement mechanism.

Yet further, according to the features of the preferred embodiments of the present invention, an undulated portion is continuously formed along an inside surface of the cylindrical wall of the terminal plate, while a protrusion is provided on an outer periphery of the rotor which is elastically displaceable in a radial direction of the rotor, thereby bringing the protrusion into contact with the undulated portion under a resilient force so as to constitute the intermittent movement mechanism.

BRIEF DESCRIPTION OF THE DRAWINGS

The above and other objects, features and advantages of the present invention will become more apparent from the following detailed description which is to be read in conjunction with the accompanying drawings, in which.

DETAILED DESCRIPTION OF THE PREFERRED EMBODIMENTS

Figure 1:
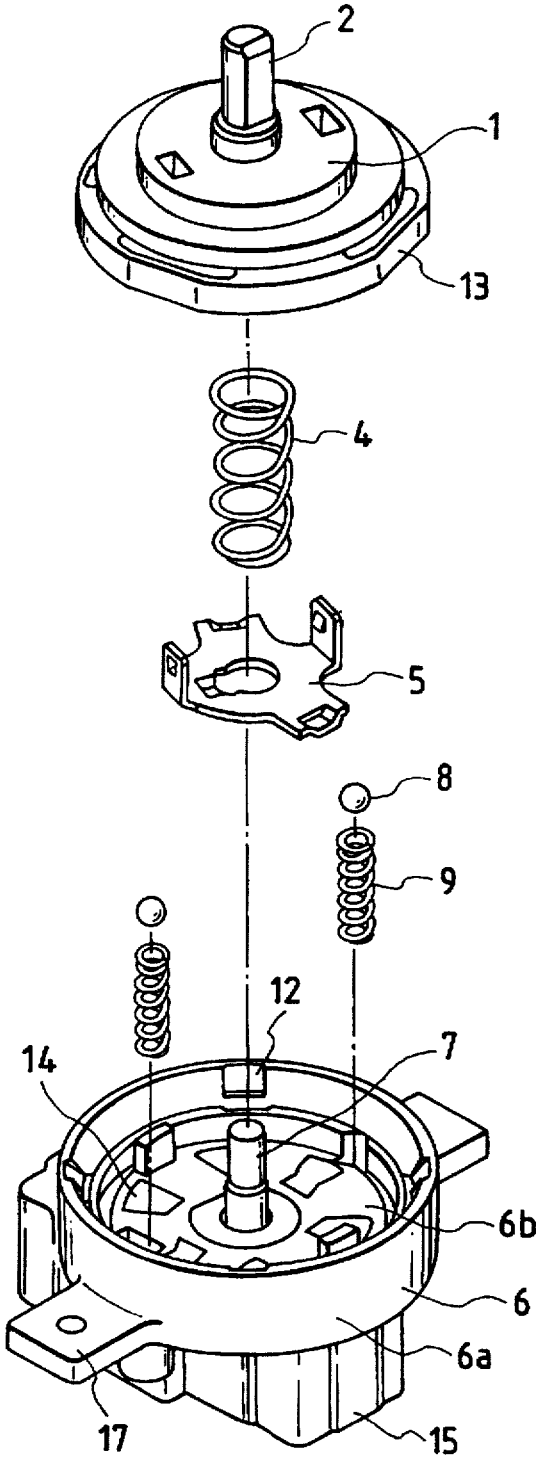
FIG. 1 is an exploded view showing a rotary switch in accordance with a first embodiment of the present invention.

Preferred embodiments of the present invention will be explained in greater detail hereinafter, with reference to the accompanying drawings. Identical parts are denoted by an identical reference numerals throughout views.

First Embodiment

Figure 2:
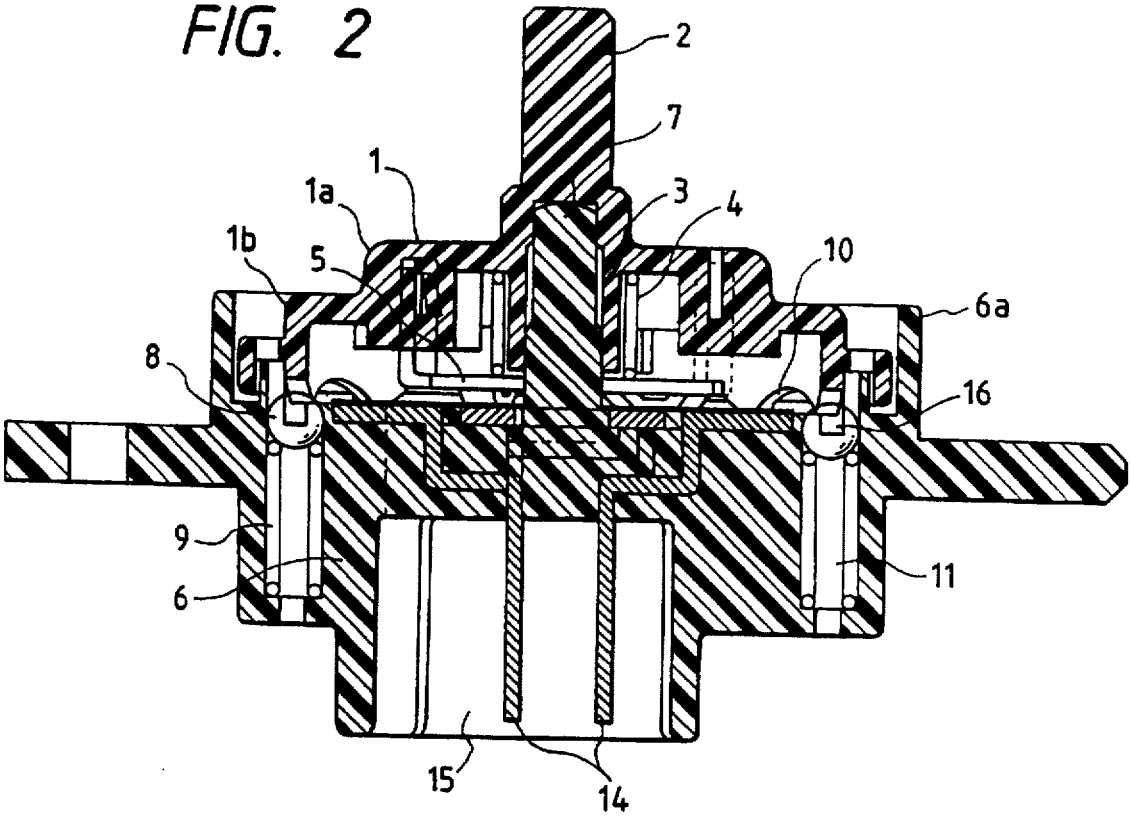
FIG. 2 is a cross-sectional side view showing the rotary switch in accordance with the first embodiment of the present invention.
Figure 3:
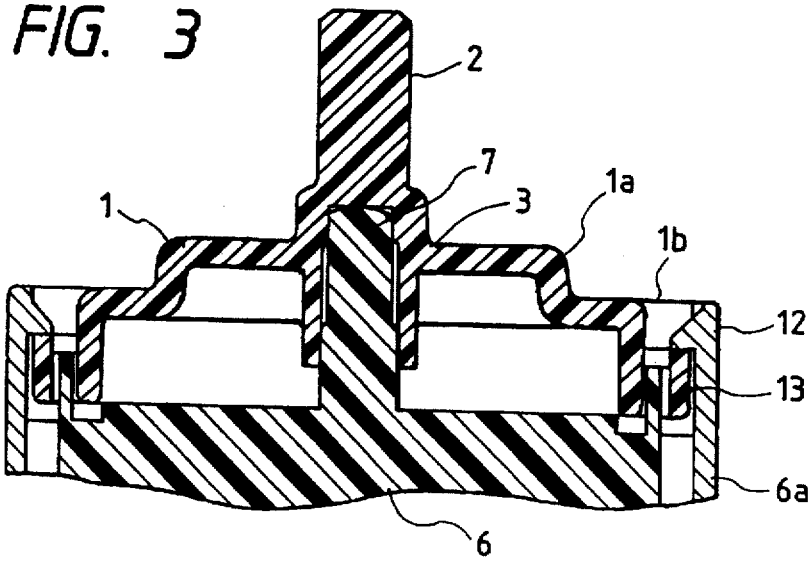
FIG. 3 is a cross-sectional side view showing an essential portion of the rotary switch in accordance with the first embodiment of the present invention.

A rotary switch in accordance with a first embodiment of the present invention will be explained with reference to FIGS. 1 through 3.

A rotor 1 has a cylindrical shaft 2 at the top thereof and a cylindrical bore 3 inside thereof. Cylindrical shaft 2 has a cutout face, formed along a chord, extending in parallel to the central axis. Shaft 2 and bore 3 are provided centrally so as to be aligned coaxially with each other. Shaft 2 is used to operate (rotate) this rotary switch. Rotor 1 is engaged with a contact piece 5 which is urged by a compression spring 4.

A terminal plate 6, rotatably holding rotor 1 thereon, is formed into a circular cup shape having a guide shaft 7 at a center thereof so as to extend coaxially with bore 3 and shaft 2. Projection 7 is coupled into bore 3. Bore 3 and guide shaft 7 cooperatively constitute a bearing means.

Rotor 1 has a base 1*a* formed into a disk shape and a cylindrical wall 1*b* extending downward from the base 1*a*. Undulated portion 10 is continuously formed along the lower edge of the cylindrical wall 1*b*.

A ball 8, urged by a compression spring 9, is engaged with or brought into contact with undulated portion 10. Ball 8 is held in a guide hole 11. Guide hole 11 has a slit 16 to prevent interference between ball 8 and undulated portion 10 when rotor 1 rotates. Ball 8, compression spring 9 and undulated portion 10 cooperatively constitute a means for causing an intermittent movement. Such an intermittent movement mechanism, disposed between rotor 1 and terminal plate 6, allows contact piece 5 to rotate against a resilient force, intermittently changing its rotational angle in accordance with a rotation of rotor 1.

A rigid claw 12 is provided on an upper peripheral end of cylindrical wall 6*a* of terminal plate 6. Rigid claw 12 is locked with an elastically deformable portion 13 formed on the outer side surface of cylindrical wall 1*b*. Rigid claw 12 and elastically deformable portion 13 cooperatively constitute a snap-in engagement mechanism for securely engaging rotor 1 with terminal plate 6.

Terminal plate 6 has a flat bottom 6*b*. A plurality of terminals 14 are provided on flat bottom 6*b* by insert molding or insert caulking so as to form part of a control circuit. Contact piece 5, urged by compression spring 4, and terminals 14 cooperatively constitute a contact means for opening or closing the control circuit.

A connector 15, provided under the terminal plate 6, is a unit for sending out a signal of the control circuit to an external device (not shown).

A switch installation flange 17, protruding from the outer side surface of cylindrical wall 6*a*, is connectable to the opponent component by means of an appropriate fastening member.

An operation of the above-described rotary switch will be explained. Rotor 1 rotates in synchronism with the rotation of shaft 2, causing a rotation about guide shaft 7 of terminal plate 6 by the function of bearing means constituted by bore 3 of rotor 1 and guide shaft 7 of terminal plate 6.

Provision of the snap-in engagement mechanism, constituted by rigid claw 12 of terminal plate 6 and elastically deformable portion 13 of rotor 1, effectively prevents rotor 1 from being removed from terminal plate 6 undesirably.

An appropriate operation torque is given by the intermittent movement means constituted by ball 8, compression spring 9 and undulated portion 10.

Figure 13:
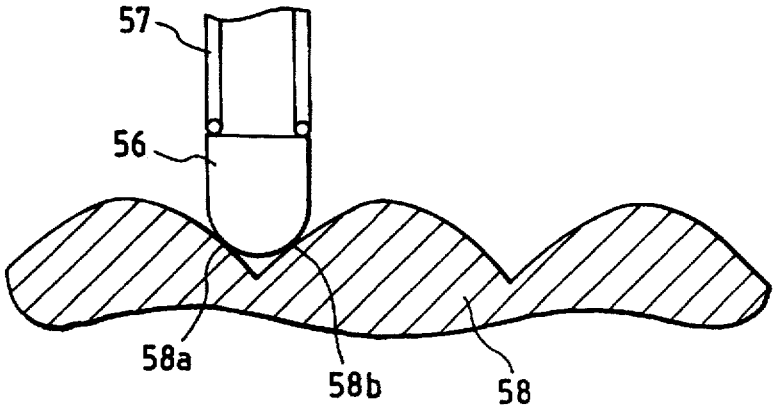
FIG. 13 PRIOR ART
FIG. 13 is a cross-sectional view illustrating an operation of the conventional rotary switch.
Figure 12:
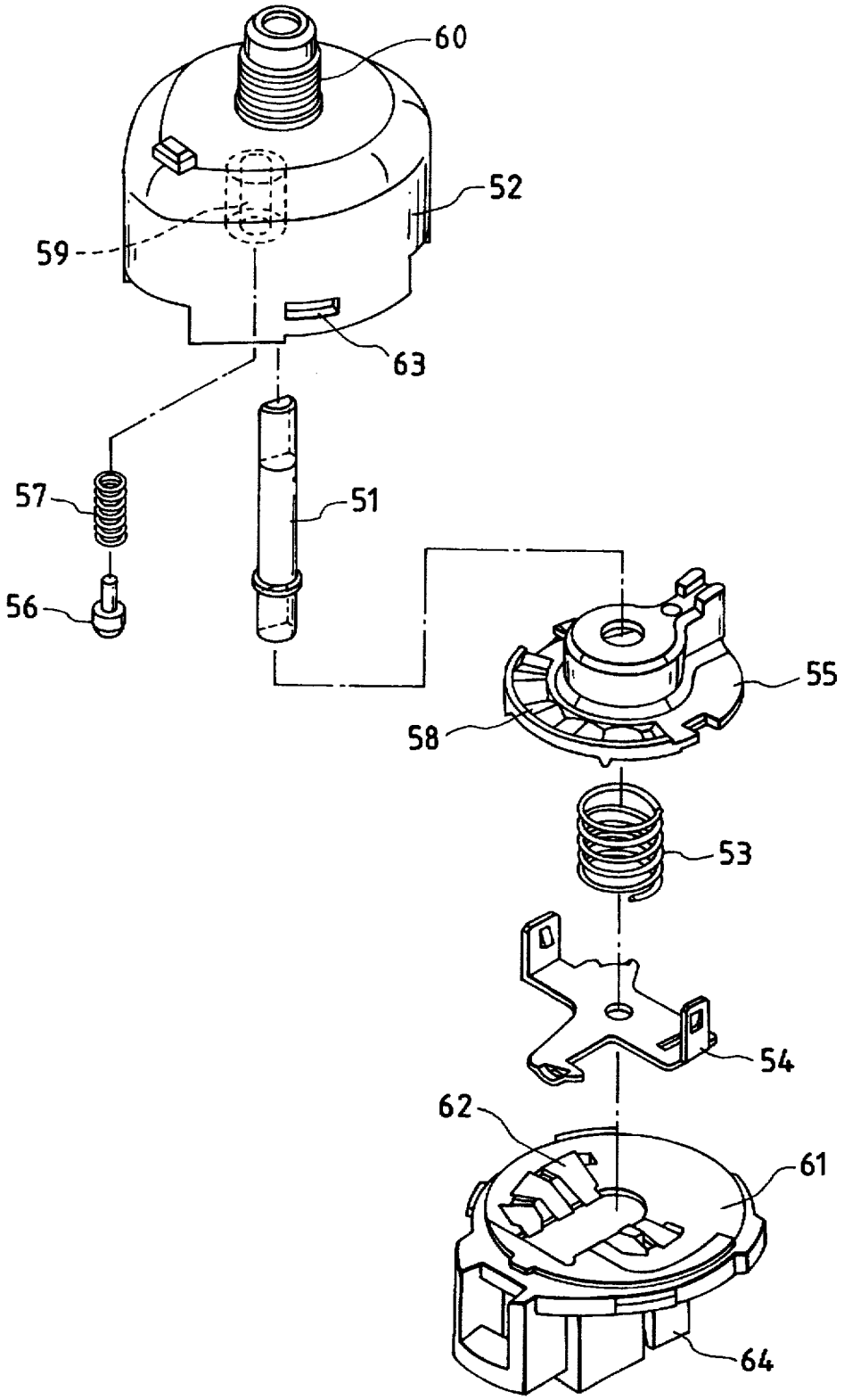
FIG. 12 PRIOR ART
FIG. 12 is an exploded view showing a conventional rotary switch.

The mechanism for causing the operational torque and the mechanism for opening or closing the control circuit are substantially identical with those explained with reference to FIGS. 12 and 13, and therefore will not be explained.

Second Embodiment

Figure 4:
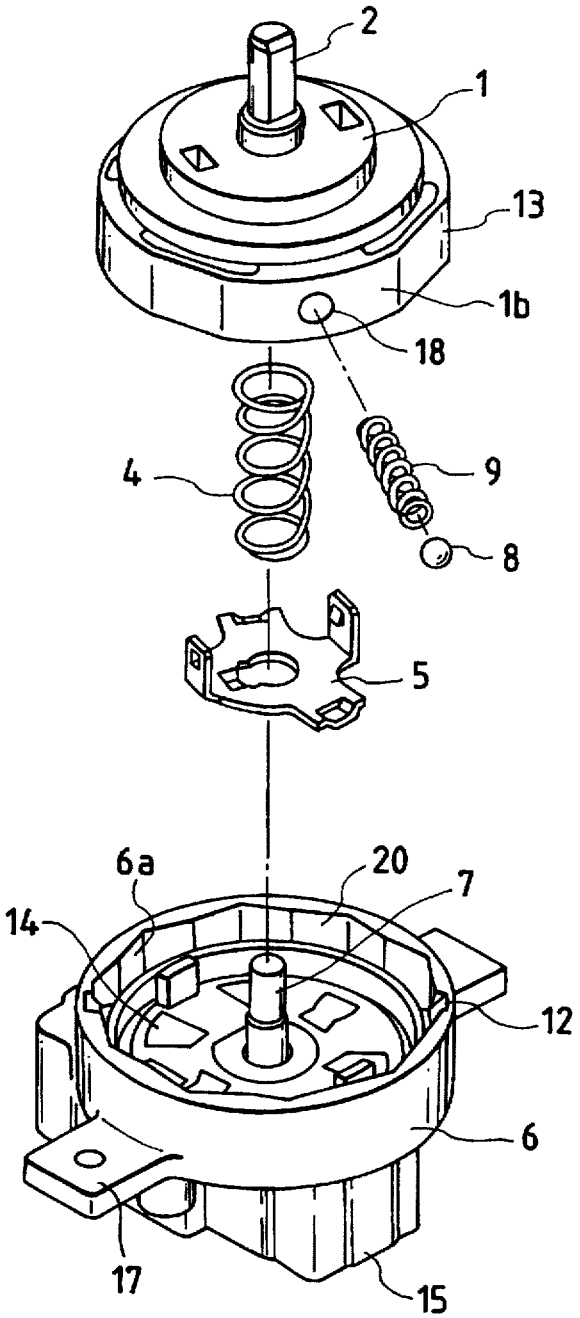
FIG. 4 is an exploded view showing a rotary switch in accordance with a second embodiment of the present invention.

FIG. 4 shows a rotary switch in accordance with a second embodiment of the present invention. The second embodiment is different from the first embodiment in the arrangement of the intermittent movement means.

Ball 8 and compression spring 9 are lodged in a lateral hole 18 formed on the cylindrical wall 1*b* of rotor 1. Ball 8 is urged by compression spring 9 so as to protrude from rotor 1 in a radial direction thereof. An undulated portion 20 is formed along the inside surface of the cylindrical wall 6*a* of terminal plate 6. Thus, ball 8 is brought into contact with undulated portion 20 under the urgent force of compression spring 9. Ball 8, compression spring 9 and undulated portion 20 cooperatively constitute the intermittent movement means of the second embodiment.

Third Embodiment

Figure 5:
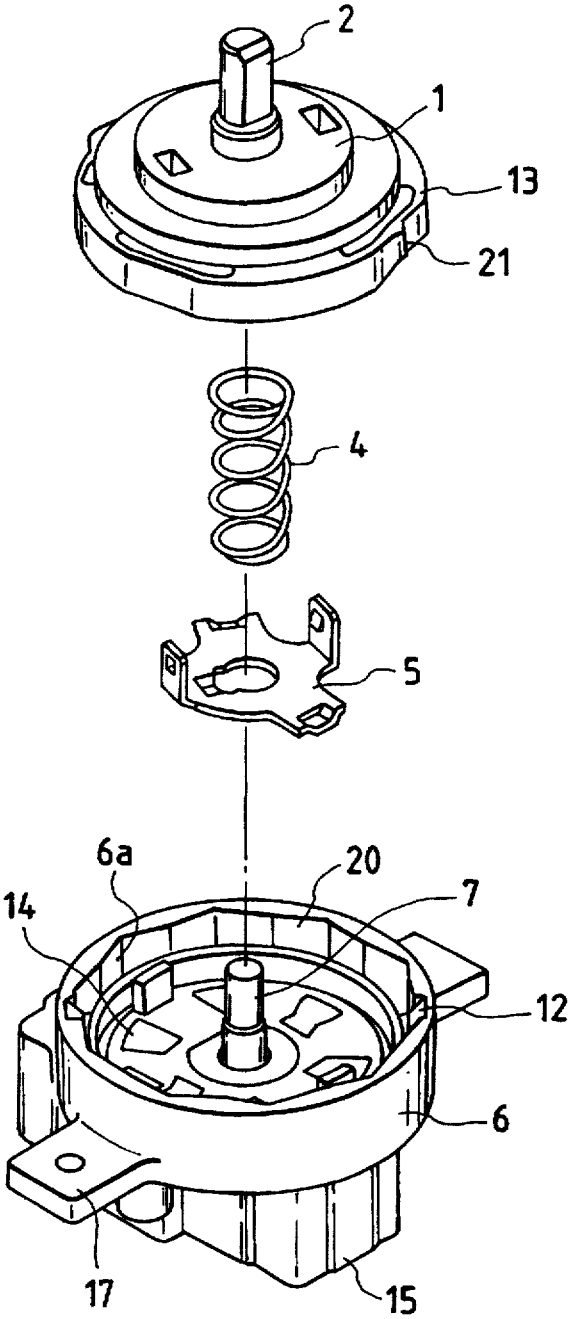
FIG. 5 is an exploded view showing a rotary switch in accordance with a third embodiment of the present invention.

FIG. 5 shows a rotary switch in accordance with a third embodiment of the present invention. The third embodiment is different from the second embodiment in the arrangement of the intermittent movement means.

A protrusion 21, provided at the center of the outer surface of elastically deformable portion 13, is a ridge extending in the direction of an axis of rotor 1. Protrusion 21 is resiliently displacable in the radial direction of rotor 1 by the elasticity of deformable portion 13.

Protrusion 21 is brought into contact with undulated portion 20 formed on the inside surface of the cylindrical wall 6*a* of terminal plate 6.

Protrusion 21 and undulated portion 20 cooperatively constitute the intermittent movement means of the third embodiment.

Fourth Embodiment

Figure 6:
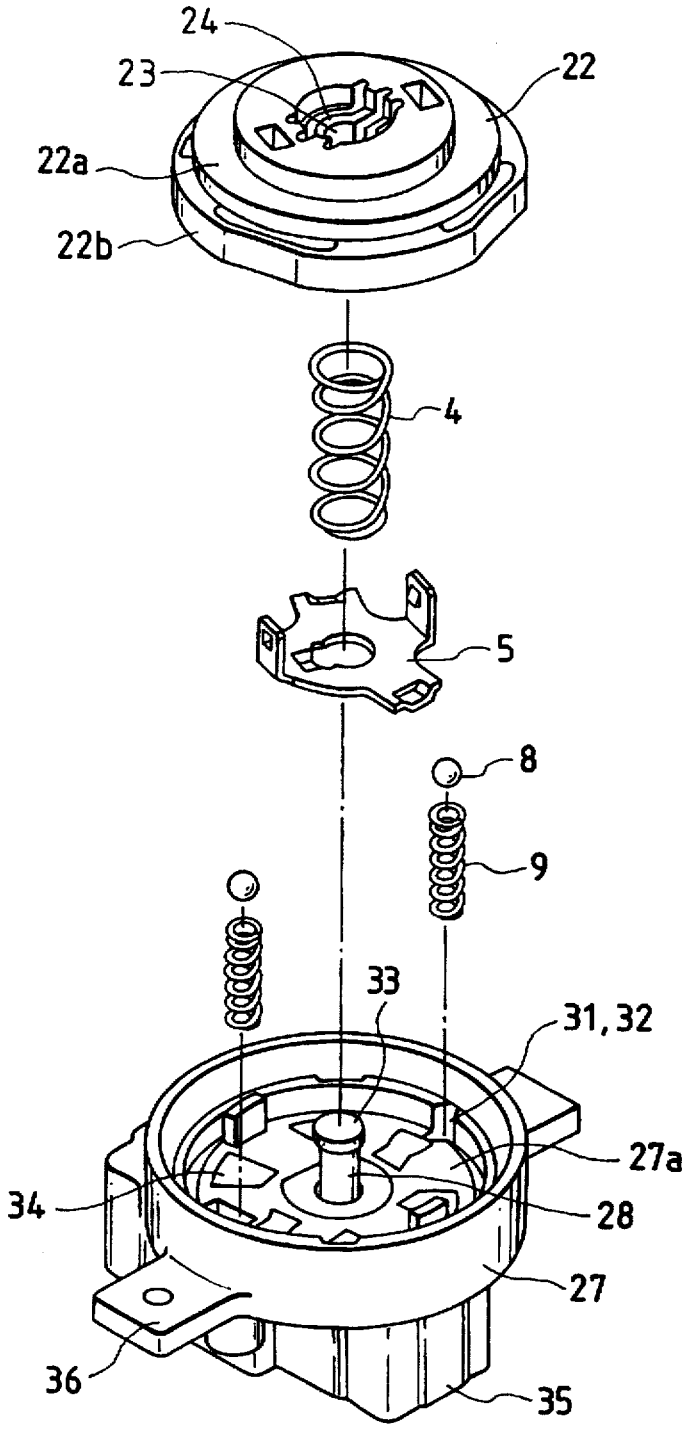
FIG. 6 is an exploded view showing a rotary switch in accordance with a fourth embodiment of the present invention.

FIG. 6 shows a rotary switch in accordance with a fourth embodiment of the present invention. A rotor 22 of the fourth embodiment has a cylindrical guide hole 23 surrounded by an elastically deformable ring 24. Elastically deformable ring 24 is integrally formed with rotor 22 at the center thereof. More specifically, a circular or arc cutout is formed concentrically around guide hole 23 so as to form elastically deformable ring 24 around guide hole 23. Contact piece 5, urged by compression spring 4, is engaged with rotor 22.

A terminal plate 27, rotatably holding rotor 22 thereon, is formed into a circular cup shape having a guide shaft 28 at a center thereof so as to extend coaxially with the guide hole 23. Guide shaft 28 is coupled into guide hole 23. Guide shaft 28 and guide hole 23 cooperatively constitute a bearing means.

Rotor 22 has a base 22*a* formed into a disk shape and a cylindrical wall 22*b* extending downward from the base 22*a*. Undulated portion (not shown) is continuously formed along the lower edge of the cylindrical wall 22*b* in the same manner as the first embodiment (see FIG. 2).

A ball 8, urged by compression spring 9, is engaged with or brought into contact with undulated portion of cylindrical wall 22*b* of rotor 22. Ball 8 is held in a guide hole 32. Guide hole 32 has a slit 31 to prevent interference between ball 8 and undulated portion when rotor 22 rotates. Ball 8, compression spring 9 and undulated portion of cylindrical wall 22*b* of rotor 22 cooperatively constitute a means for causing an intermittent movement.

A stopper flange 33 is formed on the top of guide shaft 28 of terminal plate 27. Stopper flange 33 is coupled or locked with elastically deformable ring 24 formed at the center of rotor 22, preventing rotor 22 from being disengaged from terminal plate 27. The diameter of guide hole 23 is larger than the diameter of guide shaft 28 but is smaller than the diameter of stopper flange 33. Stopper flange 33 and elastically deformable ring 24 cooperatively constitute a snap-in engagement mechanism for securely engaging rotor 22 with terminal plate 27.

Terminal plate 27 has a flat bottom 27*a*. A plurality of terminals 34 are provided on flat bottom 27*a* by insert molding or insert caulking so as to form part of a control circuit. Contact piece 5 urged by compression spring 4 and terminals 34 cooperatively constitute a contact means for opening or closing the control circuit.

A connector 35, provided under the terminal plate 27, is a unit for sending out a signal of the circuit to an external device (not shown). A switch installation flange 36, protruding from the outer side surface of cylindrical wall of terminal plate 27, is connectable to the opponent component by means of an appropriate fastening member.

An operation of the above-described rotary switch in accordance with the fourth embodiment is substantially the same as the first embodiment.

Rotor 22 rotates in synchronism with the rotation of an operation means (not shown), causing a rotation about guide shaft 28 of terminal plate 27 by the function of bearing means constituted by guide hole 23 of rotor 22 and guide shaft 28 of terminal plate 27.

Provision of the snap-in engagement mechanism, constituted by stopper flange 33 of terminal plate 27 and elastically deformable ring 24 of rotor 22, effectively prevents rotor 22 from being removed from terminal plate 27 undesirably.

An appropriate operation torque is given by the intermittent movement means constituted by ball 8, compression spring 9 and the undulated portion of cylindrical wall 22*b* of rotor 22.

The mechanism for causing the operational torque and the mechanism for opening or closing the circuit are substantially identical with the first embodiment and therefore will not be explained.

Fifth Embodiment

Figure 7:
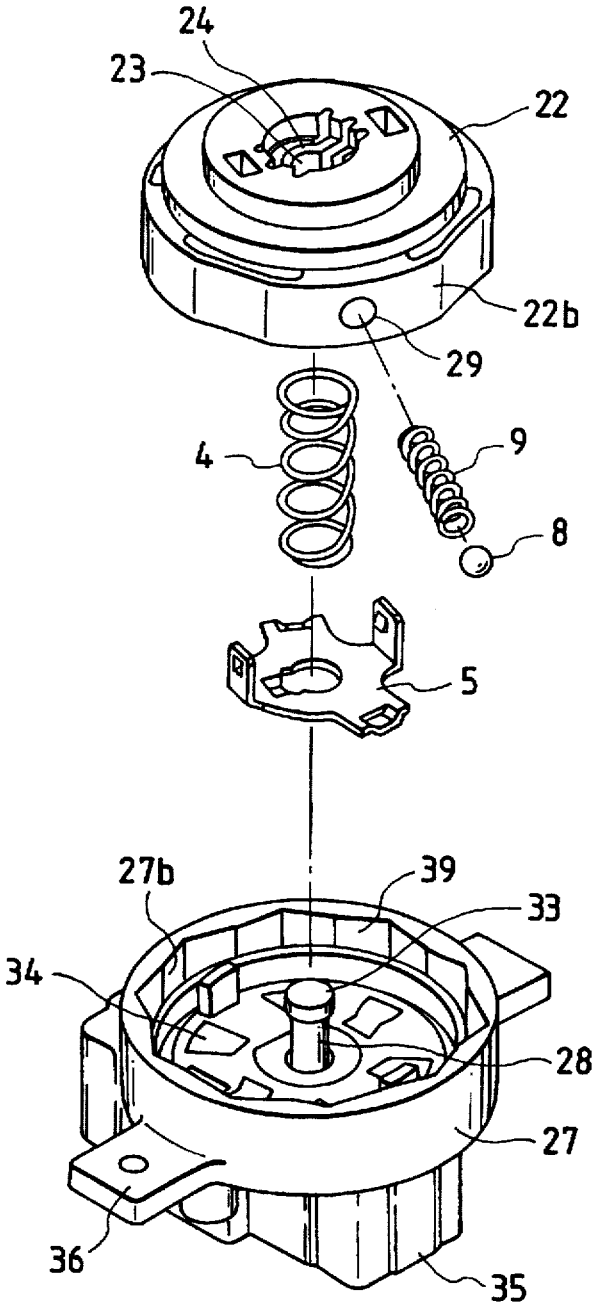
FIG. 7 is an exploded view showing a rotary switch in accordance with a fifth embodiment of the present invention.

FIG. 7 shows a rotary switch in accordance with a fifth embodiment of the present invention. The fifth embodiment is different from the fourth embodiment in the arrangement of the intermittent movement means.

Ball 8 and compression spring 9 are lodged in a lateral hole 29 formed on the cylindrical wall 22*b* of rotor 22. Ball 8 is urged by compression spring 9 so as to protrude from rotor 22 in a radial direction thereof. An undulated portion 39 is formed along the inside surface of a cylindrical wall 27*b* of terminal plate 27. Thus, ball 8 is brought into contact with undulated portion 39 under the urgent force of compression spring 9. Ball 8, compression spring 9 and undulated portion 39 cooperatively constitute the intermittent movement means of the fifth embodiment.

Sixth Embodiment

Figure 8:
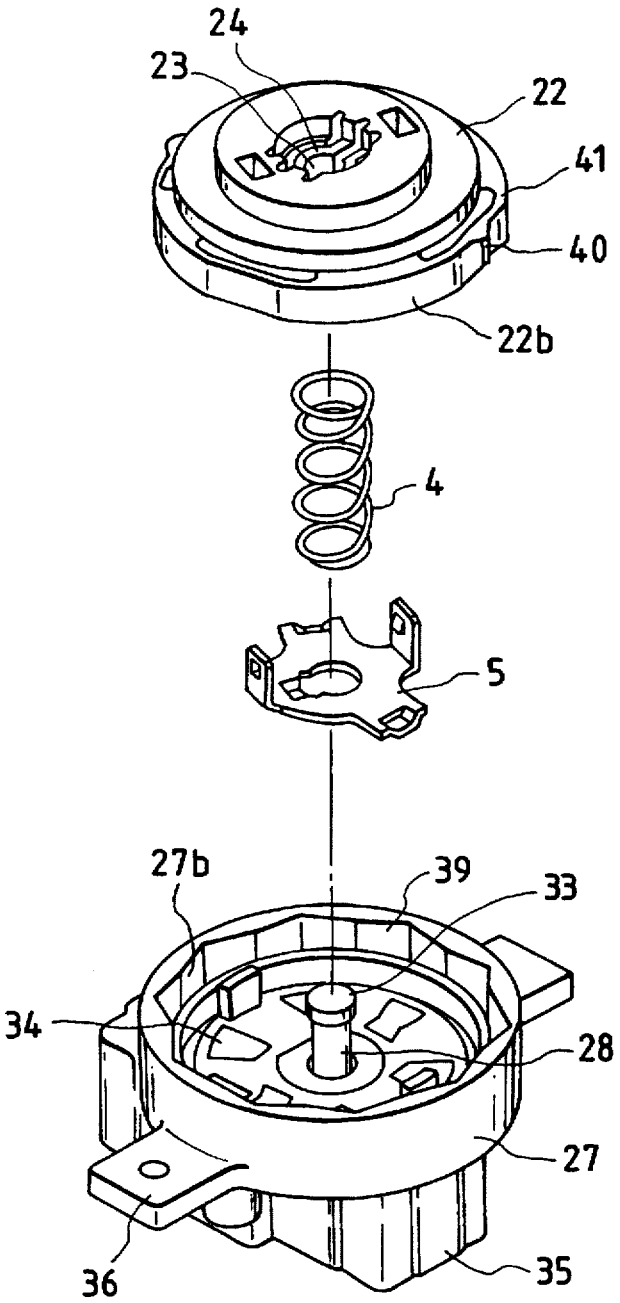
FIG. 8 is an exploded view showing a rotary switch in accordance with a sixth embodiment of the present invention.

FIG. 8 shows a rotary switch in accordance with a sixth embodiment of the present invention. The sixth embodiment is different from the fifth embodiment in the arrangement of the intermittent movement means.

An elastically deformable portion 41 is formed on the outer side surface of cylindrical wall 22*b* of rotor 22.

A protrusion 40 is provided at the center of the outer surface of elastically deformable portion 41. Protrusion 40 is a ridge extending in the direction of an axis of rotor 22. Protrusion 40 is resiliently displacable in the radial direction of rotor 22 by the elasticity of deformable portion 41.

Protrusion 40 is brought into contact with undulated portion 39 formed on the inside surface of the cylindrical wall 27*b* of terminal plate 27.

Protrusion 40 and undulated portion 39 cooperatively constitute the intermittent movement means of the sixth embodiment.

Figure 9:
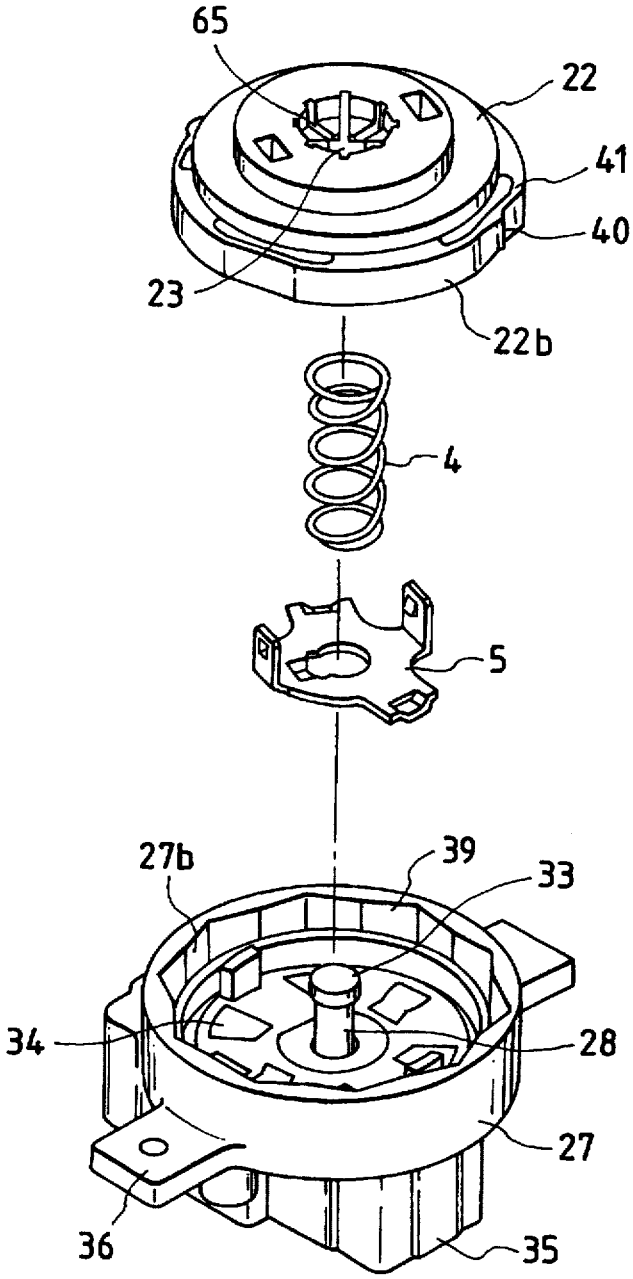
FIG. 9 is an exploded view showing a rotary switch in accordance with a modification of the sixth embodiment of the present invention.

FIG. 9 shows a modification of the rotary switch in accordance with the sixth embodiment of the present invention. A plurality of slits 65 extending in radial directions are provided around guide hole 23 of rotor 22, instead of providing elastically deformable ring 24.

Seventh Embodiment

Figure 10:
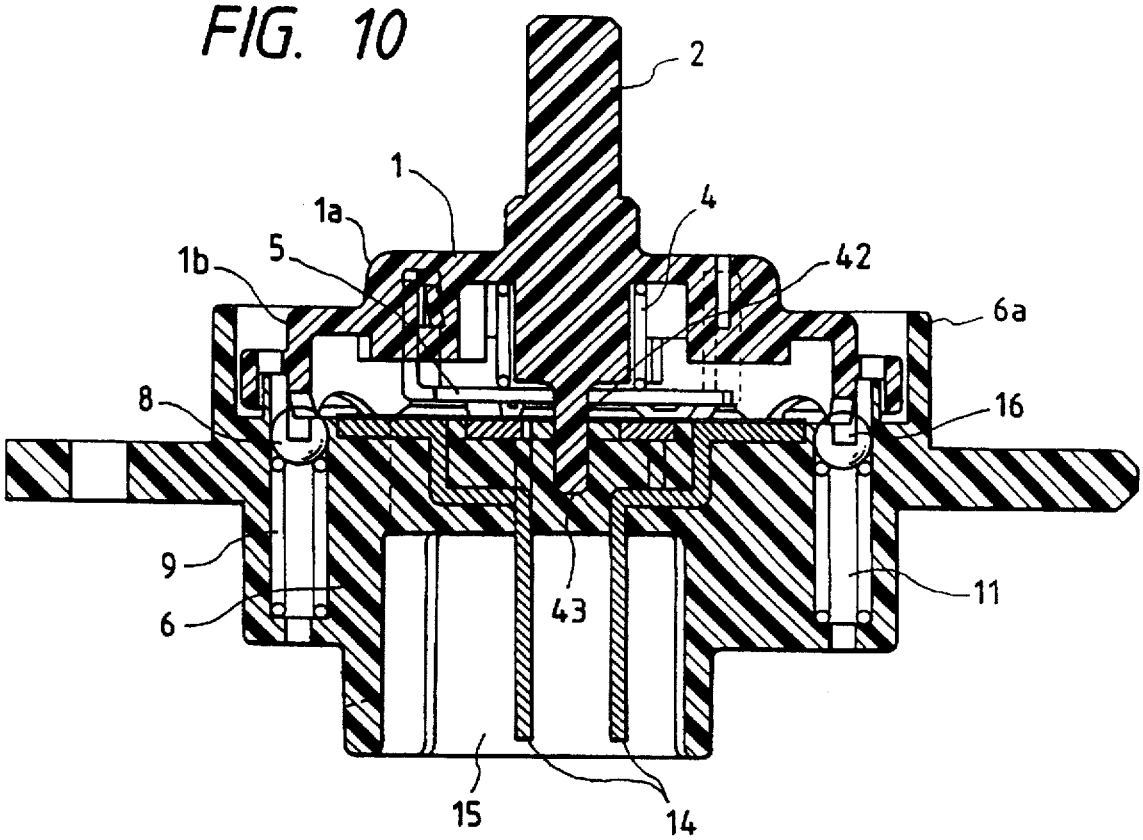
FIG. 10 is a cross-sectional view showing a rotary switch in accordance with a seventh embodiment of the present invention.

FIG. 10 shows a rotary switch in accordance with a seventh embodiment of the present invention. The seventh embodiment is different from the first embodiment in the arrangement of the bearing means.

A guide shaft 42, opposed to shaft 2, is provided at the center of rotor 1 so as to extend downward from base 1*a* in the direction of the axis of rotor 1. Guide shaft 42 is inserted or coupled in a bore 43 formed at the center of terminal plate 6. Guide shaft 42 and bore 43 cooperatively constitute a bearing means of the seventh embodiment.

Eighth Embodiment

Figure 11:
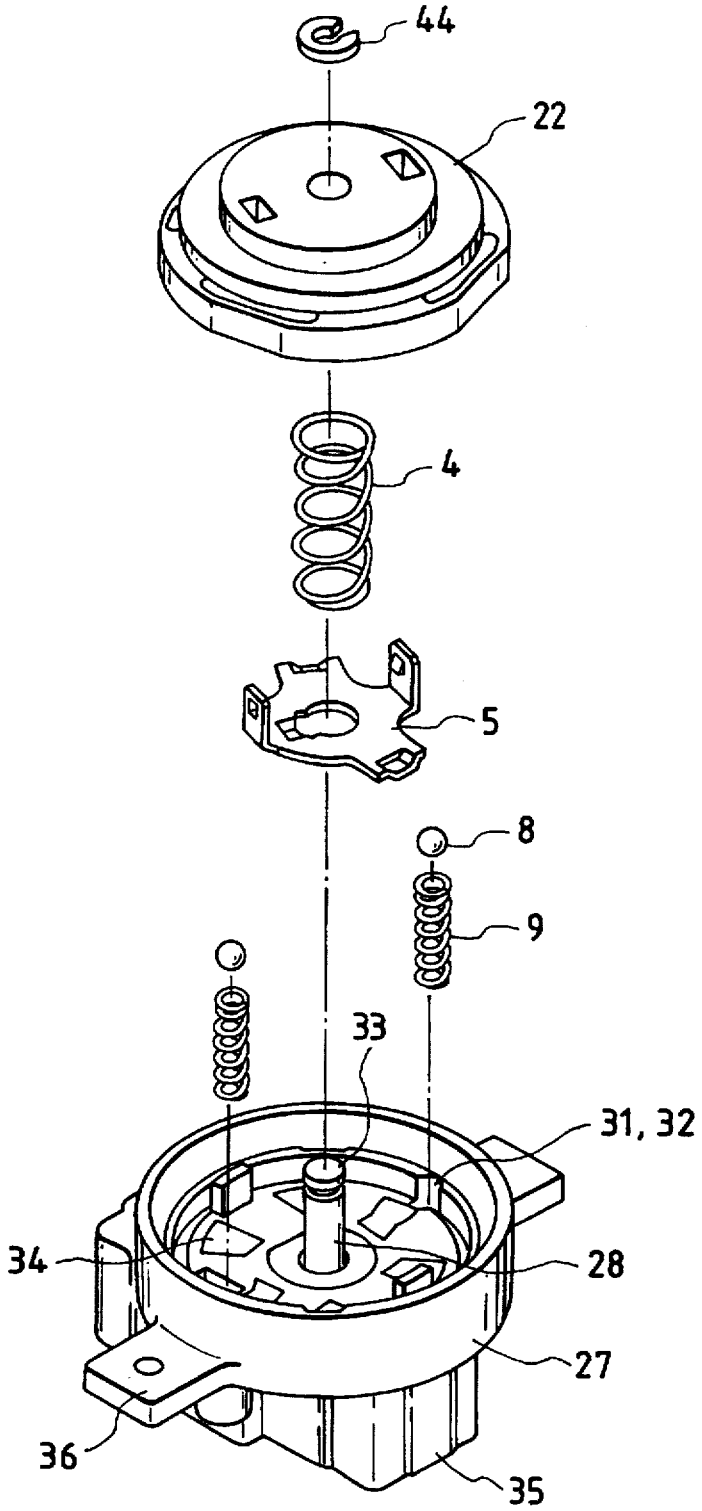
FIG. 11 is an exploded view showing a rotary switch in accordance with an eighth embodiment of the present invention.

FIG. 11 shows a rotary switch in accordance with an eighth embodiment of the present invention.

The eighth embodiment is different from the fourth embodiment in the arrangement of the snap-in engagement mechanism.

A ring 44, which is a resin or metallic product independent of rotor 22, is engageable with stopper flange 33, so as to securely engage rotor 22 with terminal plate 27.

Ring 44 and stopper flange 33 of terminal plate 27 cooperatively constitute the snap-in engagement mechanism of the eighth embodiment.

As apparent from the foregoing description, the present invention provides a novel and excellent arrangement of a rotor and a terminal plate, by the combination of which the bearing means and the snap-in engagement mechanism are constituted without requiring special parts. Thus, the number of parts and costs can be reduced.

As this invention may be embodied in several forms without departing from the spirit of essential characteristics thereof, the present embodiments as described are therefore intended to be only illustrative and not restrictive, since the scope of the invention is defined by the appended claims rather than by the description preceding them, and all changes that fall within metes and bounds of the claims, or equivalents of such metes and bounds, are therefore intended to be embraced by the claims.

What is claimed is:

1. A rotary switch comprising:

a terminal plate formed into a circular cup shape having a bottom and a cylindrical wall;

terminals provided on said bottom of said terminal plate;

a rotor rotatably supported on said terminal plate;

a contact piece resiliently engaged with said rotor so that said contact piece is selectively brought into contact with said terminals on the bottom of said terminal plate to close a circuit; and an intermittent movement mechanism, the components of which are mounted on said rotor and said terminal plate, said intermittent movement mechanism allowing said contact piece to intermittently rotate against a resilient force to change its rotational angle in accordance with a rotation of said rotor;

wherein a guide shaft is provided on a center of said bottom of said terminal plate so as to extend in an axial direction of said rotor, a stopper flange is provided on a top of said guide shaft, and a guide hole is formed on a center of said rotor so that said rotor is locked with said terminal plate by inserting said guide shaft into said guide hole.

2. The rotary switch in accordance with claim 1, wherein an engaging claw is provided on a top of said cylindrical wall of said terminal plate, and said engaging claw is locked with an outer periphery of said rotor.

3. The rotary switch in accordance with claim 1, wherein a plurality of slits extending in radial directions are provided around said guide hole.

4. The rotary switch in accordance with claim 1, wherein an elastically deformable ring is formed around said guide hole.

5. The rotary switch in accordance with claim 1, wherein a guide shaft is provided on a center of said bottom of said terminal plate so as to extend in an axial direction of said rotor, and said guide shaft is inserted into a bore formed on said rotor.

6. The rotary switch in accordance with claim 1, wherein a guide shaft is provided at a center of said rotor so as to extend downward in an axial direction of said rotor, and said guide shaft is inserted into a bore formed on said bottom of said terminal plate.

7. A rotary switch Comprising:

a terminal plate formed into a circular cup shape having a bottom and a cylindrical wall;

terminals provided on said bottom of said terminal plate;

a rotor rotatably supported on said terminal plate;

a contact piece resiliently engaged with said rotor so that said contact piece is selectively brought into contact with said terminals on the bottom of said terminal plate to close a circuit; and an intermittent movement mechanism, the components of which are mounted on said rotor and said terminal plate, said intermittent movement mechanism allowing said contact piece to intermittently rotate against a resilient force to change its rotational angle in accordance with a rotation of said rotor;

wherein an undulated portion is continuously formed along a lower edge of a cylindrical wall of said rotor, while a ball urged by a spring is provided on said terminal plate, thereby bringing said ball into contact with said undulated portion under a resilient force of said spring so as to constitute said intermittent movement mechanism.

8. A rotary switch comprising:

a terminal plate formed into a circular cup shape having a bottom and a cylindrical wall;

terminals provided on said bottom of said terminal plate;

a rotor rotatably supported on said terminal plate;

a contact piece resiliently engaged with said rotor so that said contact piece is selectively brought into contact with said terminals on the bottom of said terminal plate to close a circuit; and an intermittent movement mechanism, the components of which are mounted on said rotor and said terminal plate, said intermittent movement mechanism allowing said contact piece to intermittently rotate against a resilient force to change its rotational angle in accordance with a rotation of said rotor;

wherein an undulated portion is continuously formed along an inside surface of said cylindrical wall of said terminal plate, while a ball urged by a spring is lodged in a bore formed on a side surface of said rotor, thereby bringing said ball into contact with said undulated portion under a resilient force of said spring so as to constitute said intermittent movement mechanism.

9. A rotary switch comprising:

a terminal plate formed into a circular cup shape having a bottom and a cylindrical wall;

terminals provided on said bottom of said terminal plate;

a rotor rotatably supported on said terminal plate;

a contact piece resiliently engaged with said rotor so that said contact piece is selectively brought into contact with said terminals on the bottom of said terminal plate to close a circuit; and an intermittent movement mechanism, the components of which are mounted on said rotor and said terminal plate, said intermittent movement mechanism allowing said contact piece to intermittently rotate against a resilient force to change its rotational angle in accordance with a rotation of said rotor;

wherein an undulated portion is continuously formed along an inside surface of said cylindrical wall of said terminal plate, while a protrusion is provided on an outer periphery of said rotor which is elastically displaceable in a radial direction of said rotor, thereby bringing said protrusion into contact with said undulated portion under a resilient force of said spring so as to constitute said intermittent movement mechanism.

* * * * *